United States Patent [19]

Manning et al.

[11] 4,044,358

[45] Aug. 23, 1977

[54] SELF ERECTABLE STRUCTURE

[75] Inventors: William P. Manning; Louis Maus, both of Tulsa, Okla.

[73] Assignee: Rockwell International Corporation, El Segundo, Calif.

[21] Appl. No.: 670,828

[22] Filed: Sept. 25, 1967

[51] Int. Cl.[2] ..... H01Q 15/00; H01Q 17/00

[52] U.S. Cl. ..... 343/18 A; 343/18 B; 428/12; 428/101

[58] Field of Search ..... 343/18 A, 18 B; 161/49, 161/53, 69, 130, 132; 428/12, 101

[56] References Cited

U.S. PATENT DOCUMENTS

| | | | |
|---|---|---|---|
| 2,072,152 | 3/1937 | Blake et al. | 161/53 UX |
| 2,742,387 | 4/1956 | Giuliani | 343/18 B |
| 2,771,602 | 11/1956 | Kuhnhold | 343/18 A |
| 2,828,484 | 3/1958 | Skellett | 343/18 A |
| 3,001,196 | 9/1961 | McIlroy et al. | 343/18 B |
| 3,152,033 | 10/1961 | Black et al. | 161/130 X |
| 3,227,601 | 1/1966 | Crosby | 161/69 |
| 3,314,846 | 4/1967 | Niwa | 161/69 |

*Primary Examiner*—Malcolm F. Hubler

[57] ABSTRACT

An interference type radar attenuator is described formed of a plurality of thin sheets having selected admittance values. The sheets are spaced apart by thin plastic spacer members having a shape memory so that the sheets can be compressed together by deforming the plastic spacers for very tight packaging and, upon release of the packaging, the sheets return to a spaced relation for effective radar attenuation. A similar structure is useful in space vehicles for thermal shielding and as a meteroid bumper.

14 Claims, 7 Drawing Figures

INVENTORS.
WILLIAM P. MANNING
LOUIS MALIS
BY Richard D. Seibel
ATTORNEY

INVENTORS.
WILLIAM P. MANNING
LOUIS MAUS
BY Richard D. Seibel
ATTORNEY

SELF ERECTABLE STRUCTURE

BACKGROUND

In many situations it is desirable to provide a radar attenuating surface on or surrounding a structure or vehicle in order to minimize the ability of an enemy to detect or track the structure or vehicle. In order to provide effective radar attenuation by interference techniques at very low radar frequencies it is usually necessary to employ a relative thick structure at the surface. This thick structure may make the transport of the item difficult because of its bulkiness.

A vehicle in which the transport problem is particularly acute comprises a space vehicle such as a satellite or the like. During launch of a satellite it is desirable to have as small a package as possible for minimizing aerodynamic drag and minimizing the weight of any necessary surrounding shrouds and the like. It is also desirable to satellite structures to employ as light a weight as possible for all components of the vehicle. It is therefore desirable to provide a light weight radar attenuator for a space vehicle that is readily packaged into a small volume for launch and subsequently deployed for providing relatively thick radar attenuator.

BRIEF SUMMARY OF THE INVENTION

Thus, in the practice of this invention according to a preferred embodiment there is provided a self erectable structure comprising a plurality of thin sheets of flexible material, and a plurality of flexible connecting members spacing the sheets apart at selected distances. The connecting members are constructed of a material having shape memory so that they deform when the sheets are compressed or compacted together for packaging and extend to a full sheet spacing when the packaging is released.

Objects and many of the attendant advantages of this invention will be readily appreciated as the same becomes better understood by reference to the following detailed description when considered in conjunction with the accompanying drawings wherein.

Figure 7:
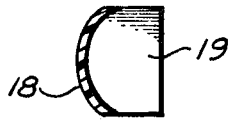
Figure 6:
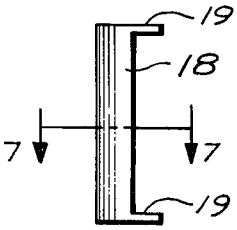
FIG. 6 illustrates another alternative spacing member.

FIG. 7 comprises a cross section of the spacing member of FIG. 6.

Throughout the drawings like reference numerals refer to like parts.

Electromagnetic waves such as radar may be absorbed by a so-called quarter wave or Salisbury screen which comprises a thin layer of material having an impedance of about 377 ohms per square spaced exactly one quarter wavelength from a reflective surface. Such an absorber is described in U.S. Pat. No. 2,599,944. Since an absorber of this type prevents radar reflection by a mechanism of destructive interference at one quarter wavelength from a reflective surface it is found to be highly sensitive to frequency and will attenuate radar only within a narrow frequency band. It is found, however, that such an interference absorber also attenuates radiation at odd multiples of one quarter wavelength.

Further, it is found that a series of resistive layers individually spaced from a reflective surface at different distances each attenuate radiation at differnet wavelengths and a broad band radar attenuator can be achieved. The impedance of the successive layers spaced apart from the reflective surface and the spacing therebetween is governed by interactions between the successive sheets and these sheets may not each be provided with an impedance 377 ohms per square. In general it is found that the first sheet upon which radar is expected to impinge should have an effective impedance, as seen by an incoming radar wave, of about 377 ohms per square in order to have minimal reflection of radar therefrom. Successive sheets between the outermost layer and the reflective layer have successively lower impedances down to the substantially zero impedance of the reflective layer. The selection of impedances for the various sheets and the spacing therebetween are readily determined for particular frequency ranges of attenuation by one skilled in the art. It is preferred that the sheets have d.c. resistivities in the range of from about 40 to 2000 ohms per square to provide effective attenuation in a multilayer, broad band radar attenuator. In general, the total thickness of attenuator spaced from the reflective layer is determined by the longest wavelength of radar to be attenuated; this distance approximating one quarter of the longest wavelength of the radiation. The distance between successive sheets is likewise determined by reference to the shortest wavelengths it is desired to attenuate; this distance being approximated by one quarter of the shortest wavelength.

Previously interference type absorbers have been formed of carbon loaded fabric sheets spaced apart by non-metallic honeycomb materials or have comprised similar relative heavy and rigid structures. These absorbers are unduly heavy and bulky for application in most space situations.

A significant problem associated with interference type absorbers is the substantial thickness that must be employed in a design for attenuation of lower frequency radar. This difficulty is circumvented herein by making the radar attenuator material erectable in space and, thereby, providing the necessary dimensions without violating limitations on storage space aboard the space vehicle. Also, because the radar attenuator material may be damage by boost heating, thermal protection during launching boost is necessary. To keep the weight to a minimum, it is mandatory that the radar attenuator material be deployed from a compact volume that can be shielded with a relatively small amount of thermal protection material. With these considerations in mind, there is provided a high-performance, lightweight radar attenuator that is self-erecting from a compacted configuration and which can meet the variety of constraints imposed by space environments and spacecraft systems.

Figure 1:
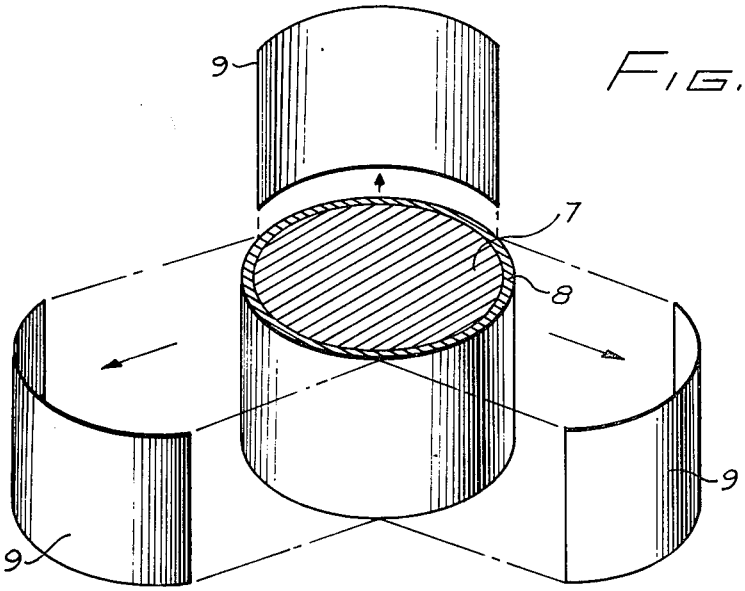
FIG. 1 illustrates in perspective a space vehicle and jettisonable shrouds.

FIG. 1 illustrates in perspective a spacecraft 7 having its cylindrical sides covered with a radar attenuator material 8 as provided in practice of this invention according to a preferred embodiment. The spacecraft is arbitrarily shown as a regular cylinder, however, it will be apparent that other regular and irregular shapes may be involved. The radar attenuator material 8 is covered during launch of the space vehicle with a plurality of shrouds 9 which are jettisoned when the spacecraft has reached a position where aerodynamic forces will not damage the radar attenuator. Coventional releasing mechanisms (not shown) such as quick disconnects, latches or explosive bolts are employed for jettisoning the shrouds at high altitudes.

Figure 2:
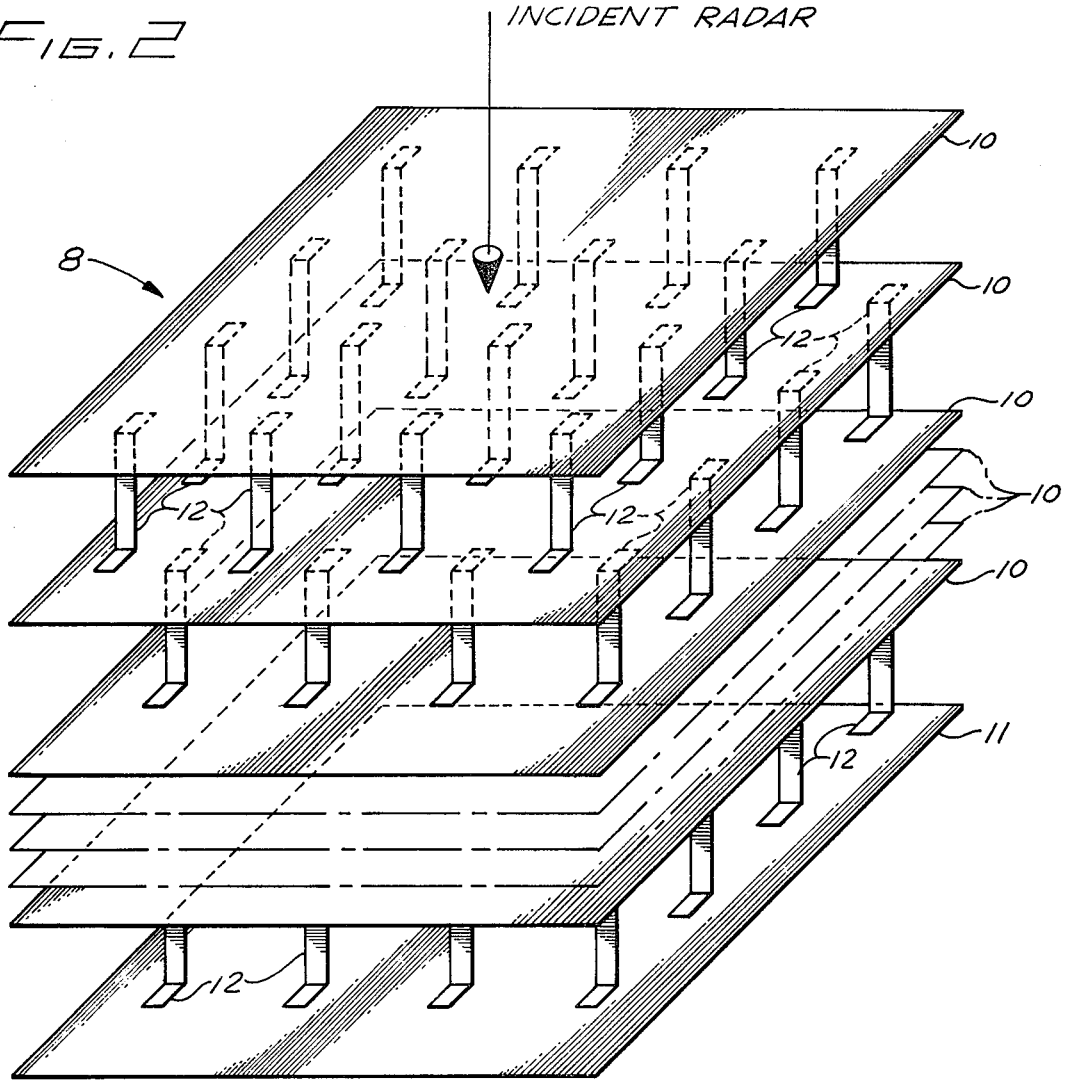
FIG. 2 illustrates a self erectable structure constructed according to the principles of this invention for use on the vehicle of FIG. 1.

FIG. 2 illustrates in perspective a portion of the self erectable, light weight interference absorber 8 from FIG. 1, constructed according to the principles of this invention. As illustrated therein there are provided a plurality of attenuator sheets 10 mutually spaced apart from each other and spaced apart from a reflective sheet 11. (A portion of the attenuator sheets 10 are shown closely spaced and in phantom in FIG. 2 only for purposes of illustration and it will be understood that the sheets are usually uniformly spaced apart). The attenuator sheets 10 preferably comprise thin plastic membranes, each having a resistive or poorly conductive layer printed, vacuum metallized, or otherwise suitably secured thereon in order to provide a selected impedance for radar attenuation. The innermost sheet 11, that is, the sheet furthest from the surface upon which incident radar is expected to impinge is preferably formed of a vacuum metallized plastic sheet having sufficient conductive material deposited thereon to provide good electrical conductivity. If desired in certain instances the innermost layer 11 may comprise a metallic surface of the space vehicle or the like. In general, however, the external surface of the vehicle may have a geometry unsatisfactory for providing optimum radar attenuation and it is therefore desirable to provide an additional conductive surface 11 for the radar attenuator which may have a different geometry then the vehicle being covered. It will be apparent that, although the embodiment of FIG. 2 is illustrated as flat that it represents a portion of the curved structure of FIG. 1 and that the several sheets can still be considered substantially parallel.

The several attenuator sheets 10 and the conductive layer 11 are each spaced apart by a plurality of non-metallic connecting members 12. It is significant that the connecting members are non-conductive since the presence of conductive material would give large radar reflections. Each of the connecting members 12 comprises a central spacing portion 13 and a pair of end tabs 14 connected at opposite ends of the spacing portion 13 in a general Z shape. In the described and illustrated embodiment the spacing portion 13 of the connecting members are all the same length. It will be apparent that the spacing portions between different sheets may be of different lengths so that the sheets are spaced apart differing distances. It is preferred that the end tabs 14 disposed at right angles to the spacing portion 13 when the connecting members are unstressed. Each of the end tabs 14 on each connecting member 12 is attached to one of a pair of attenuator sheets 10 (or to the reflective layer 11). The connecting members serve to prevent the sheets from being further apart than the spacing portion since they can act in tension. They also serve to prevent the sheets from being closer together than the spacing portion since they can act in compression. Further, they provide the force required for deployment of the sheets upon release of any constraints thereon.

Figure 3:
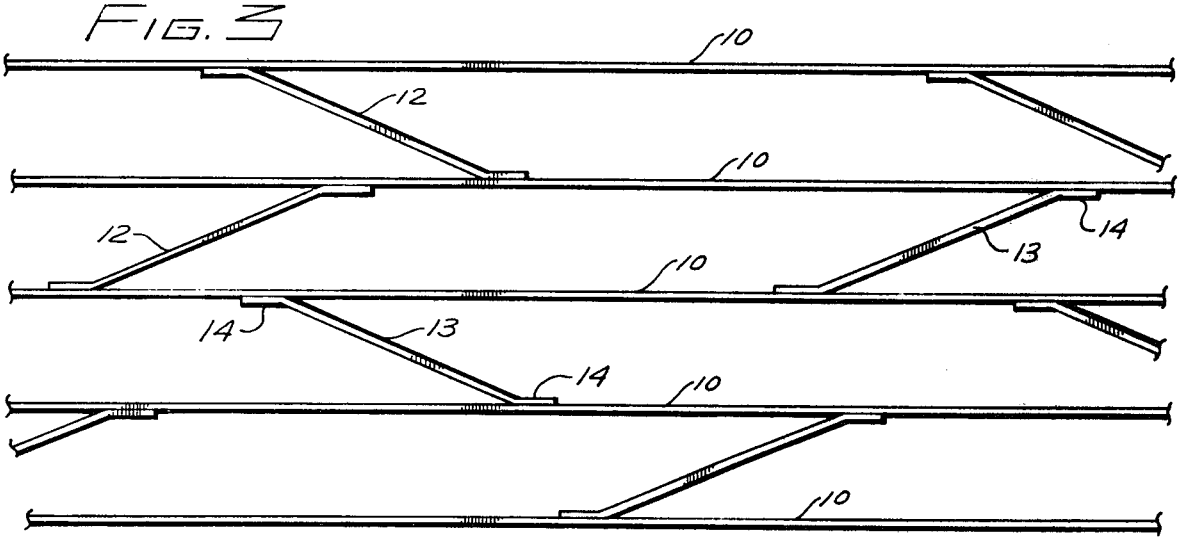
FIG. 3 illustrates in section a portion of the structure of FIG. 2 partly compressed for packaging.

The connecting members 12 are preferably made of thin plastic having a shape memory so that they can be deformed for compressing the sheets together and spring back to the original position for spacing apart. The property of shape memory is an elastic property and indicates that prolonged deformation does not vitiate the elastic response due to creep or relaxation under the stress of deformation. Thus, as illustrated in FIG. 3, the connecting members 12 are bent as the sheets 10 are compressed or compacted together thereby permitting the entire assemblage to be compacted and squeezed into a relatively small package. As illustrated in FIG. 3 the sheets are only partly compressed together and the connecting members are only partly bent for purposes of illustration. It will be apparent to one skilled in the art that upon full compression of the assemblage so that the sheets 10 are substantially in contact, that the connecting members 12 are bent substantially flat against the sheets 10. It will be appreciated that, whereas in FIG. 3 the consecutive sheets are shown to have shifted relative to each other in opposite directions so as to straighten out the Z shaped connecting members 12, in practice many of the connecting members 12 will buckle in the spacing portion 13 in addition to bending at the intersection of the spacing portion 13 and the end tabs 14 and that the sheets 10 may not displace much laterally from each other in the course of compression in the assemblage. It is found in practice that compressing an assemblage of sheets as described and illustrated involves buckling and bending of the connecting members 12 and usually some wrinkling of the attenuator sheets 10 so that the entire assemblage is not compressed uniformly and to its maximum theoretical limit.

Figure 4:
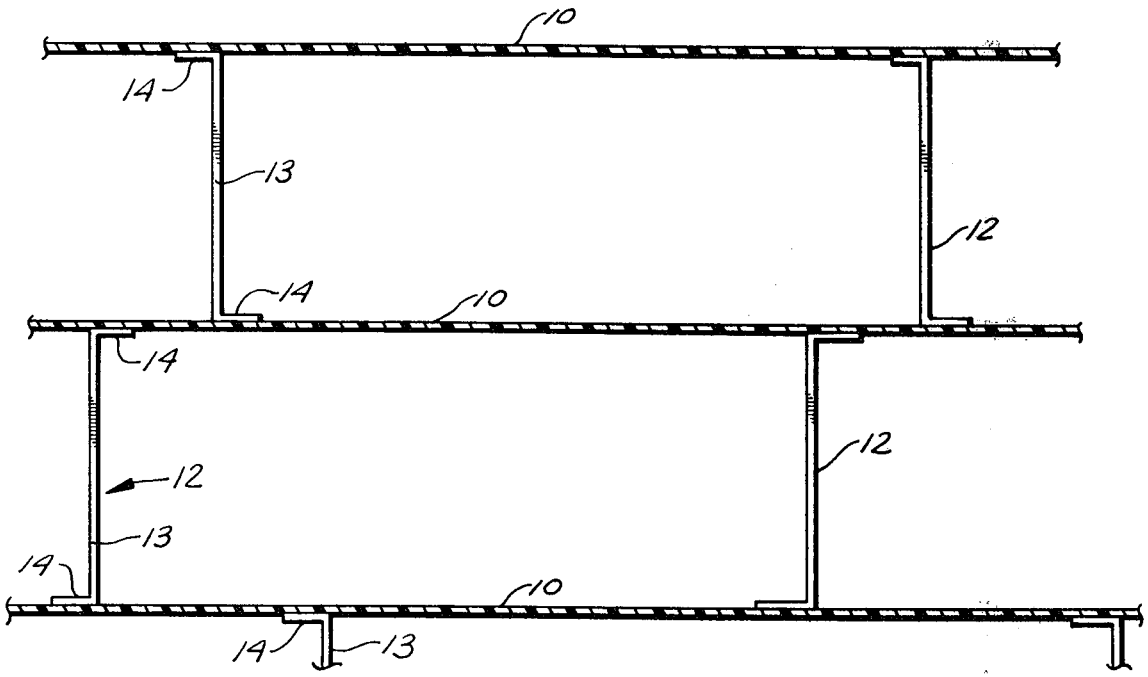
FIG. 4 illustrates in section a portion of the structure of FIG. 3 fully extended.

As pointed out hereinabove the sheets and connecting members are compacted into a relatively small packaging volume for launch of a satellite. Upon release of the restraining shrouds 9 (FIG. 1) holding the sheets in compression during launch the Z shaped connecting members 12 act as a large plurality of springs and straighten out into a right angled Z shape substantially as illustrated in FIG. 4 wherein a few typical sheets 10 are spaced apart at their full extent by the spacing portion 13 of the connecting members 12.

The connecting members 12 are preferably formed of a non-conductive plastic material that exhibits a property known as shape memory. This is an ability to return to an original shape even after extended periods of deformation. Many plastic materials, although having adequate elasticity, may be unsuitable for such application because of their propensity toward "creeping" when deformed for substantial periods of time. A material particularly well suited to this requirement and having good shape memory comprises orientated sheets of polyethylene terephthalate such as is marketed under the trade name Mylar by E. I. duPont de Nemours Company. The connecting members can readily be formed by bending into the desired shape and heating to about 300° F. Upon cooling the film remains in the new geometry and even when deformed therefrom for a substantial time will naturally and spontaneously return to this geometry when released. It will be apparent to one skilled in the art that polyester films besides Mylar and many of the polyamide films (nylon) or polyvinylchloride are also suitable as materials having a substantial shape memory. If the duration of compression is relatively short other elastic materials, with poorer shape memory can be employed if desired. In a specific embodiment is has been found that Mylar sheets 0.002 inch thick in ½ inch wide strips form excellent connecting members for spacing apart attenuator sheets formed of 0.001 inch thick Mylar.

In the formation of radar attenuators it is preferred that the attenuator sheets be spaced apart at well known intervals so that the attenuation achieved is readily predictable over the frequency band of interest. In order to maintain the sheets at a well known distance apart throughout their extent a plurality of connecting members 12 are provided between the several attenuator sheets. This assures support for each of the attenuator sheets at frequent intervals and provides accurate spacing of the sheets.

The presence of the dielectric connecting members between the attenuator sheets has a very slight disturbing effect on the interference phenomenon occuring in the radar attenuator. It is therefore desirable that the connecting members in successive layers be staggered from each other so that no continuous disturbance of the electrical characteristics occurs on any direct path clear through the assemblage of attenuator sheets. Thus, as illustrated in FIGS. 2 to 4 the connecting members 12 in each layer are staggered or displaced laterally from the connecting members in the other layer for minimal disturbance of the electrical characteristics of the radar attenuator.

A structure as described for spacing a plurality of light weight sheets apart is useful for providing thermal shielding. In this instance the sheets are preferably metallized with a reflective layer for reflecting radiation and relatively long thermal paths are provided between adjacent sheets for minimizing conduction. A plurality of spaced sheets are also useful as a micrometroid bumper in a space vehicle. A high velocity encounter with a micrometeroid may perforate a unitary structure, however, perforation of a few spaced sheets dissipates appreciable energy and may prevent damage to a primary structure. In either instance it may be desirable to compress and contain the plurality of sheets in a shroud or the like for transport and later deploy the sheets into spaced relation for use. A self erectable structure as provided in practice of this invention is admirably suited to such deployment.

In a specific embodiment a radar attenuator giving good broad band attenuation was constructed according to the principles of this invention. In this embodiment seven layers of metallized Mylar film were employed above a reflective ground plane for a total thickness of radar attenuator of about 24 inches. The first sheet spaced apart from the reflective layer comprised 0.001 inch thick Mylar vacuum metallized with bismuth to give an optical transmissivity of about 7% and a d.c. resistance of about 95 ohms per square. Optical transmissivity is a convenient measure of film thickness and properties dependent thereon such as resistance. Very thin films of metal are semi-transparent and the degree of transparency depends on the thickness. Since resistance also depends on thickness, it is readily correlated with transmissivity and the latter serves as a readily applied process control measure. It should also be noted that the cited resistance is d.c. and there is a change with frequency. Typically resistance at about 109 cycles per second is about twice that at d.c. and the latter is usually measured merely for convenience. This sheet was spaced from the reflective layer about 3.38 inch by means of ½ inch wide Z shaped strips of Mylar 0.002 inch thick having end tabs cemented to both the conductive reflective layer and the attenuator sheet by polyurethane cement. The connecting portion of each of the strips was about 3.38 inch long.

Each of the additional attenuator sheets was also spaced at 3.38 inch from its adjacent attenuator sheets by similar Mylar strips. The next attenuator sheet adjacent the first comprised a 0.001 inch thick Mylar sheet vacuumed metallized with bismuth to give an optical transmissivity of about 17% and a d.c. resistance of about 160 ohms per square. The next two sheets in the composite radar attenuator comprised 0.001 inch thick Mylar sheets vacuum metallized with bismuth to give an optical transmissivity of about 23.8% and a d.c. resistance of about 235 ohms per square.

The final three sheets in the composite radar attenuator comprised 0.001 inch thick Mylar vacuum metallized with bismuth to give an optical transmissivity of about 31.5% and a d.c. resistance of about 420 ohms per square. Measurements of radar echo from such a composite interference attenuator showed good absorption throughout a broad frequency range. Because of the good strength to weight ratio of Mylar, thin sheets and spacers are possible and the described self erectable attenuator weighs less than 0.10 pounds per square foot of area covered. A packing density of better that 3% is obtained, that is, the volume of the attenuator when compacted and stowed for launch is less than 3% of the volume occupied by the attenuator when fully deployed. Because of the excellent shape memory of Mylar for the connecting members the attenuator is readily packaged and stored in a compressed or compacted condition for substantial periods of time without degrading the capability to deploy the attenuator to its full extent.

Figure 5:
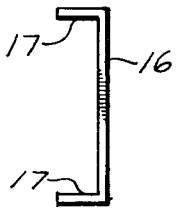
FIG. 5 illustrates an alternative spacing member.

It will be apparent that other shapes of connecting members of non-metallic materials can be employed. Thus, for example, as illustrated in FIG. 5 there is provided a connecting member having a generally U shape wherein the spacing portion 16 forms the bight of the U and the end tabs 17 form the legs of the U. A connecting member as illustrated in FIG. 5 is employed in exactly the same manner as the Z shape connecting members 12 in the embodiment of FIGS. 2 to 4.

In order to obtain a somewhat higher force for deploying and maintaining spacing in a radar attenuator, connecting members as illustrated in FIGS. 6 and 7 can be employed between the attenuator sheets of the interference type radar attenuator. As illustrated therein the connecting members comprise cradle or boat like members having a curved spacing portion 18 and flat end tabs 19. Because of the somewhat greater stiffness per unit thickness of the curved spacing portion 18 the connecting members can be somewhat thinner for a given strength, and buckling in the spacing portion 18 is virtually assured upon compression of the composite radar absorber rather than bending at the connection between the spacing portion 18 and the end tabs 19. Many other variations of connecting member can be readily provided by one skilled in the art, for example, the connecting members may be in the form of tubes with ends connected to the sheets, or the the connecting members may be divided in two classes, one acting in compression and the other in tension.

Obviously, many other modifications and variations of the present invention are possible in light of the above teachings. It is therefore to be understood that within the scope of the appended claims the invention may be practiced otherwise than as specifically described.

What is claimed is:

1. A self-erectable structure comprising:

a plurality of sheets of thin flexible material; and a plurality of thin flexible non-conductive connecting members attached between each of said sheets for spacing each of said sheets apart a selected distance, said connecting members comprising a material having shape memory so that said members deform when the structure is compressed and spontaneously return to their original shape when released; and wherein;

said sheets and said connecting members comprise a material selected from the class consisting of polyethylene terephthalate and polyvinyl chloride.

2. A self-erectable structure comprising:

a plurality of sheets of thin flexible material, at least a portion of said sheets having a resistivity in the range of from about 40 to 2,000 ohms per square; and a plurality of thin flexible non-conductive connecting members attached between each of said sheets for spacing each of said sheets apart a selected distance, said connecting members comprising a material having shape memory so that said members deform when the structure is compressed and spontaneously return to their original shape when released.

3. A self erectable structure as defined in claim 2 further comprising:

an electrically conductive thin flexible sheet on one side of the plurality of resistive sheets and spaced therefrom by a plurality of said connecting members for reflecting radar waves; and wherein said connecting members space the sheets apart a distance of about one quarter wavelength of radiation in the frequency range of radar.

4. A light weight broad band interference type radar attenuator comprising in combination:

an electrically conductive ground plane;

a plurality of semi-conductive attenuator sheets, each substantially parallel to said ground plane; and non-conductive spacing means between each of said sheets and between one of said sheets and said ground plane for spacing said sheets and said ground plane apart at selected distances, said spacing means being elastically deformable for accomodating compaction of said sheets and ground plane together and for spontaneously extending said sheets from said ground plane.

5. A radar attenuator as defined in claim 4 wherein said spacing means comprises a plurality of separate connecting members between each pair of sheets, each of said connecting members being elastically deformable between a first compacted position and a second extended position.

6. A self erectable structure as defined in claim 5 wherein each of said connecting members comprises:

a central spacing portion sufficiently thin for buckling when the structure is compressed and sufficiently strong for spontaneously straightening when the structure is released; and a pair of end portions attached to said spacing portion at substantially right angles thereto, each of said end portions being attached to one said sheets.

7. A radar attenuator as defined in claim 6 wherein connecting members on opposite sides of said sheets are displaced laterally on said sheets from each other for minimizing discontinuities in electrical properties.

8. A radar attenuator as defined in claim 6 wherein:

said ground plane comprises a metal coated sheet of plastic; and each of said attenuator sheets comprises a metal coated sheet of plastic having a resistance in the range of from 40 to 2000 ohms per square.

9. A radar attenuator as defined in claim 6 wherein said plurality of attenuator sheets comprises:

a first conductor coated plastic sheet adjacent said ground plane having a resistance of about 95 ohms per square;

a second conductor coated plastic sheet having a resistance of about 160 ohms per square;

third and fourth conductor coated plastic sheets each having a resistance of about 235 ohms per square; and fifth, sixth and seventh conductor coated plastic sheets having a resistance of about 420 ohms per square.

10. A radar attenuator as defined in claim 9 wherein said sheets are coated with a thin layer of bismuth;

said ground plane comprises a metal coated sheet of plastic; and said plastic sheets and said connecting members comprise a material selected from the class consisting of polyethylene terephthlate and polyvinyl chloride.

11. A radar attenuator as defined in claim 9 wherein said attenuator sheets and said conductive ground plane are each spaced apart substantially equal distances to give a composite thickness to the attenuator of about 2 feet for attenuating radiation at lower radar frequencies.

12. An interference type attenuator comprising:

a plurality of attenuator sheets adapted to assume a mutually spaced apart relation to provide radiation attenuation;

means interconnecting said sheets for urging them to said mutually spaced apart relation; and means for maintaining the sheets in closely compacted relation.

13. An attenuator as defined in claim 12 wherein said means for maintaining the sheets in compacted relation comprises a jettisonable aerodynamic shroud overlying the attenuator sheets.

14. An attenuator as defined in claim 12 wherein the means interconnecting the sheets comprises a plurality of elastic members which are extended when the sheets are in mutually spaced apart relation and are compacted therebetween when the sheets are in closely compacted relation.

* * * * *